United States Patent [19]

Förster

[11] 4,154,205

[45] May 15, 1979

[54] CAPACITOR IGNITION SYSTEM FOR INTERNAL-COMBUSTION ENGINES

[75] Inventor: Miklos Förster, Fürth, Fed. Rep. of Germany

[73] Assignee: Semikron, Gesellschaft für Gleichrichterbau, Nüremberg, Fed. Rep. of Germany

[21] Appl. No.: 825,467

[22] Filed: Aug. 17, 1977

[30] Foreign Application Priority Data

Aug. 18, 1976 [DE] Fed. Rep. of Germany ..... 2637102

[51] Int. Cl.[2] ..... F02P 1/00

[52] U.S. Cl. ..... 123/148 CB; 315/209 CD

[58] Field of Search ..... 123/148 CB, 148 CA, 123/148 E, 148 DS; 315/209 T, 209 CD, 209 SC

[56] References Cited

U.S. PATENT DOCUMENTS

| | | | |
|---|---|---|---|
| 3,376,470 | 4/1968 | Stone et al. | 123/148 CB |
| 3,450,942 | 6/1969 | Segall et al. | 315/209 CD |
| 3,629,652 | 12/1971 | Maycock et al. | 315/209 CD |
| 3,838,328 | 9/1974 | Lundy | 123/148 CB |
| 3,855,984 | 12/1974 | Jacobs | 123/148 CB |
| 3,918,425 | 11/1975 | Pulzer | 123/148 CB |
| 4,004,561 | 1/1977 | Thiene | 123/148 CB |

FOREIGN PATENT DOCUMENTS

| | | | |
|---|---|---|---|
| 2209006 | 8/1973 | Fed. Rep. of Germany | 123/148 CB |
| 2209007 | 8/1973 | Fed. Rep. of Germany | 123/148 CB |

*Primary Examiner*—Kathleen H. Claffy
*Assistant Examiner*—Gerald L. Brigance
*Attorney, Agent, or Firm*—Spencer & Kaye

[57] ABSTRACT

A capacitor ignition system for an internal-combustion engine of the type which basically includes a direct voltage converter and, having a control circuit coupled therewith for cyclically charging a storage capacitor, a switch-through circuit for discharging the capacitor in dependence on the firing order and a firing circuit to which the discharge voltage is fed for generating the ignition voltage for the spark plugs, wherein: a first storage capacitor essentially for storing the firing energy required to ionize the ignition spark path and a second storage capacitor essentially for storing the firing energy required to assure a period of dwell for the ignition spark are connected to the output of the direct voltage converter for charging by same and discharging via the switch-through circuit; the control circuit regulates the operation of the direct voltage converter, and includes a series-RC circuit for delaying the switching on of the direct votage converter for a period of time after the capacitors are discharged and the circuit components for charging the capacitors are dimensioned so that the frequency of charging is independent of the ignition order frequency of the breaker points of the firing circuit.

10 Claims, 3 Drawing Figures

CAPACITOR IGNITION SYSTEM FOR INTERNAL-COMBUSTION ENGINES

BACKGROUND OF THE INVENTION

The present invention relates to a capacitor ignition system for internal-combustion engines. More particularly, the present invention relates to a capacitor ignition system for an internal-combustion engine of the type including a direct voltage converter, having a control circuit coupled therewith, for cyclically charging the storage capacitor, a switch-through circuit for discharging the capacitor in dependence of the firing order for the engine and a firing circuit to which the discharge voltage is fed for generating the ignition voltage for the spark path of the spark plugs.

With such ignition systems with capacitive energy storage it is always possible, in part independently of the position of the breaker points of the firing circuit, to have available the full ignition voltage at high rise speeds, and with suitable selection of the capacitor it is also possible to generate high peak current intensities. Thus in every case high energy ignition sparks are formed between the electrodes of the spark plugs. Due to the configuration of the known systems, however, the ignition energy from the storage capacitor is used largely to form the so-called ignition spark head, i.e., to initiate the ionization of the spark path, so that it is not always assured that sufficient energy is available in the storage capacitor for the so-called post discharge, which is necessary following the ionization during the corresponding period of dwell of the spark and which also requires high energy. Due to the applicable physical laws for the capacitor discharge, devices in which all of the ignition energy is furnished by one storage capacitor do not meet all requirements during use.

Capacitor ignition systems are known in which each storage capacitor is charged by one charging pulse in that, the primary coil of a transformer connected between the control circuit and the ignition circuit is connected via a semiconductor switching device with the battery in the respective firing order (Elektronik 1968, Issue No. 8, page 239). Thus every charging process is dependent on the voltage supply so that with a low battery voltage optimum firing behavior is not assured.

Ignition systems of the above-mentioned type are also known in which although the storage capacitor is charged independently of the battery voltage, there is not always sufficient firing energy available for the post discharge (Elektronik 1966, Issue No. 7, pages 201 et seq.).

In order to overcome this drawback, an ignition system has become known in which the energy of the storage capacitor is intended to ionize the spark path, and the energy for the post discharge is obtained directly from the battery (Elektronik 1976, Issue No. 1, pages 61 et seq.). In this circuit the duration of the supply of energy from the battery is coupled with the switching period of a flip-flop stage in the control circuit and with the magnetization of the blocking oscillator type direct voltage converter of the circuit, so that a sufficient period of dwell for the ignition spark is not assured in all cases. Moreover, the storage capacitor is charged each time only with one charging pulse so that it is questionable whether the firing energy is always available in sufficient quantities under the various conditions of use.

SUMMARY OF THE INVENTION

It is the object of the present invention to provide a capacitor ignition system which meets all requirements, even under extreme operating conditions, with respect to available firing energy during the period of dwell of the ignition spark.

The above object is achieved according to the present invention in that in a capacitor ignition system for internal combustion engines of the type including a direct voltage converter, having a control circuit coupled therewith, for cyclically charging the storage capacitors, a switch-through circuit for discharging the capacitor in dependence on the firing order, and a firing circuit for generating the ignition voltage for the spark plugs from the discharge voltage; a first and a second storage capacitor are connected to the output of the direct voltage converter for charging by same and discharging via the switch-through circuit with the first storage capacitor being essentially for storing the firing energy required to ionize the ignition spark path and with the second storage capacitor being essentially for storing the firing energy required to assure a period of dwell for the ignition spark, the control circuit regulates the operation of the direct voltage converter and includes a series RC circuit for delaying the switching on of the direct voltage converter after the capacitors discharge, and the circuit components for charging the capacitors are dimensioned so that the frequency of charging is independent of the ignition order frequency of the breaker points of the firing circuit.

DETAILED DESCRIPTION OF THE PREFERRED EMBODIMENTS

Figure 1:
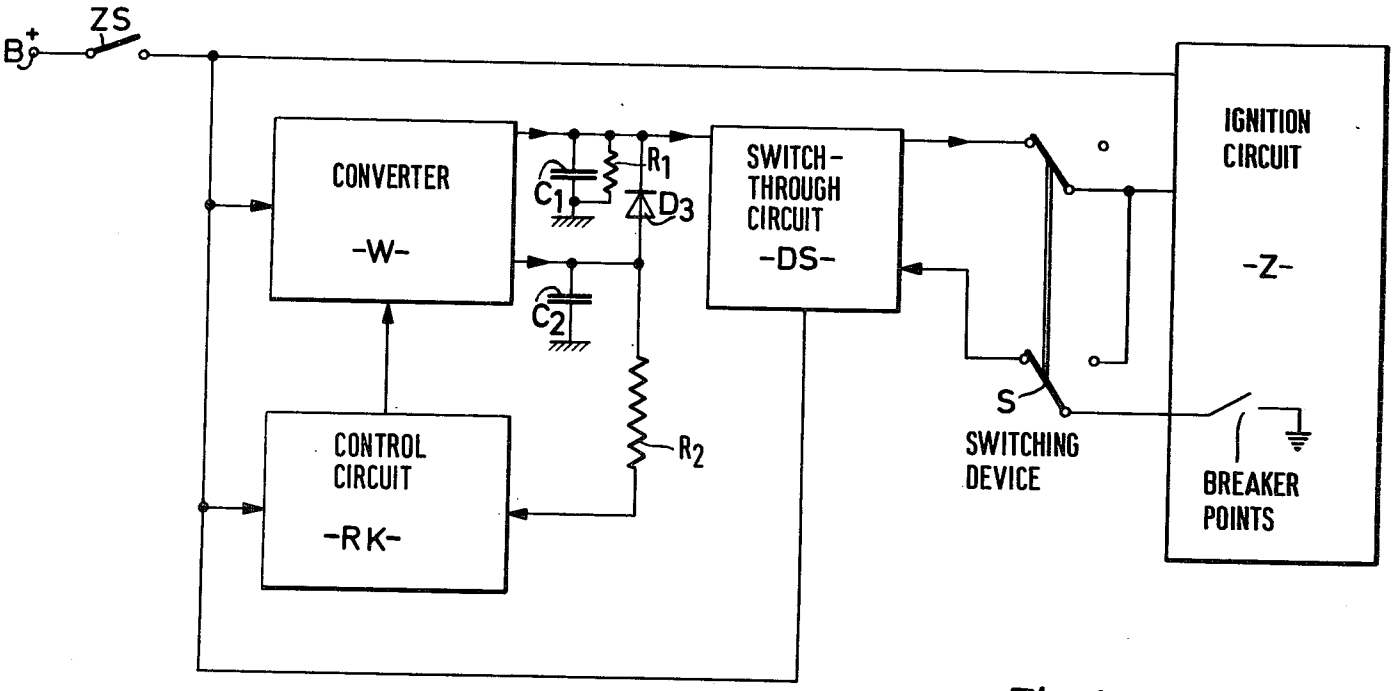
FIG. 1 is a basic block circuit diagram of an ignition system according to the invention.

Referring now to FIG. 1, the capacitor ignition system according to the invention includes a generally known direct voltage converter W, which preferably is provided in the form of a blocking oscillator type converter, which charges the two storage capacitors $C_1$, $C_2$ connected to its output when the switch-through circuit DS is open. This circuit DS in a known manner basically includes a series connected thyristor (FIG. 3) which is fired when the breaker points of the vehicle ignition system are open. Thus the converter W charges the capacitors $C_1$ and $C_2$ while the thyristor of the circuit DS blocks and the breaker points are closed. The storage capacitors $C_1$ and $C_2$ are charged with the aid of a control circuit RK, including a Schmitt trigger, which circuit monitors the voltage on the capacitors $C_1$ and $C_2$ in the illustrated embodiment via a resistor $R_2$ and regulates the operation of converter W at a frequency which is independent of the cycle of energy flow determined by opening and closing of the breaker points. When storage capacitors $C_1$ and $C_2$ are charged, the control circuit RK switches off the converter W. The oscillating frequency of converter W, i.e., the frequency of the charging pulses for the storage capacitors, may be higher, if required, than the firing frequency of the ignition system and is given by the appropriate dimensioning of the control circuit. Thus the full charge of the storage capacitors $C_1$ and $C_2$ and the same firing energy is always assured even at a high number of revolutions of the engine. Capacitor $C_1$ is intended and dimensioned for storage of the energy to form the spark head, i.e., for the ionization of the spark path and has a voltage, after charging, which will dependably generate the required firing voltage across the spark plug once the thyristor of the circuit DS has switched through to discharge the capacitor and feed the discharge energy to the ignition coil. Diode $D_3$ prevents transfer of energy from the storage capacitor $C_1$ to the storage capacitor $C_2$. Diode $D_3$ also serves to release the energy from storage capacitor $C_2$, after capacitor $C_1$ has discharged, and if the potential across the thyristor of the circuit DS is low, for the post discharge during the necessary period of dwell of the ignition spark.

According to the invention, following the discharge of capacitors $C_1$ and $C_2$, the control circuit RK switches converter W back on only after a period of delay. Since the thyristor of circuit DS blocks when its forward current is reduced to below the holding current and since, moreover, delayed actuation of the converter W causes a delay in the generation and supply of new energy after discharge of the storage capacitors, the spark dies due to the circuitry involved so that wear of parts from rotation of the distributor due to the interruption of the spark is prevented. The turn-off time of converter W thus is composed of the discharge time of the storage capacitors $C_1$, $C_2$, which time corresponds to the period of dwell of the ignition spark for the spark head and the post discharge, and of the turn-on delay time provided by the control circuit RK.

Figure 3:
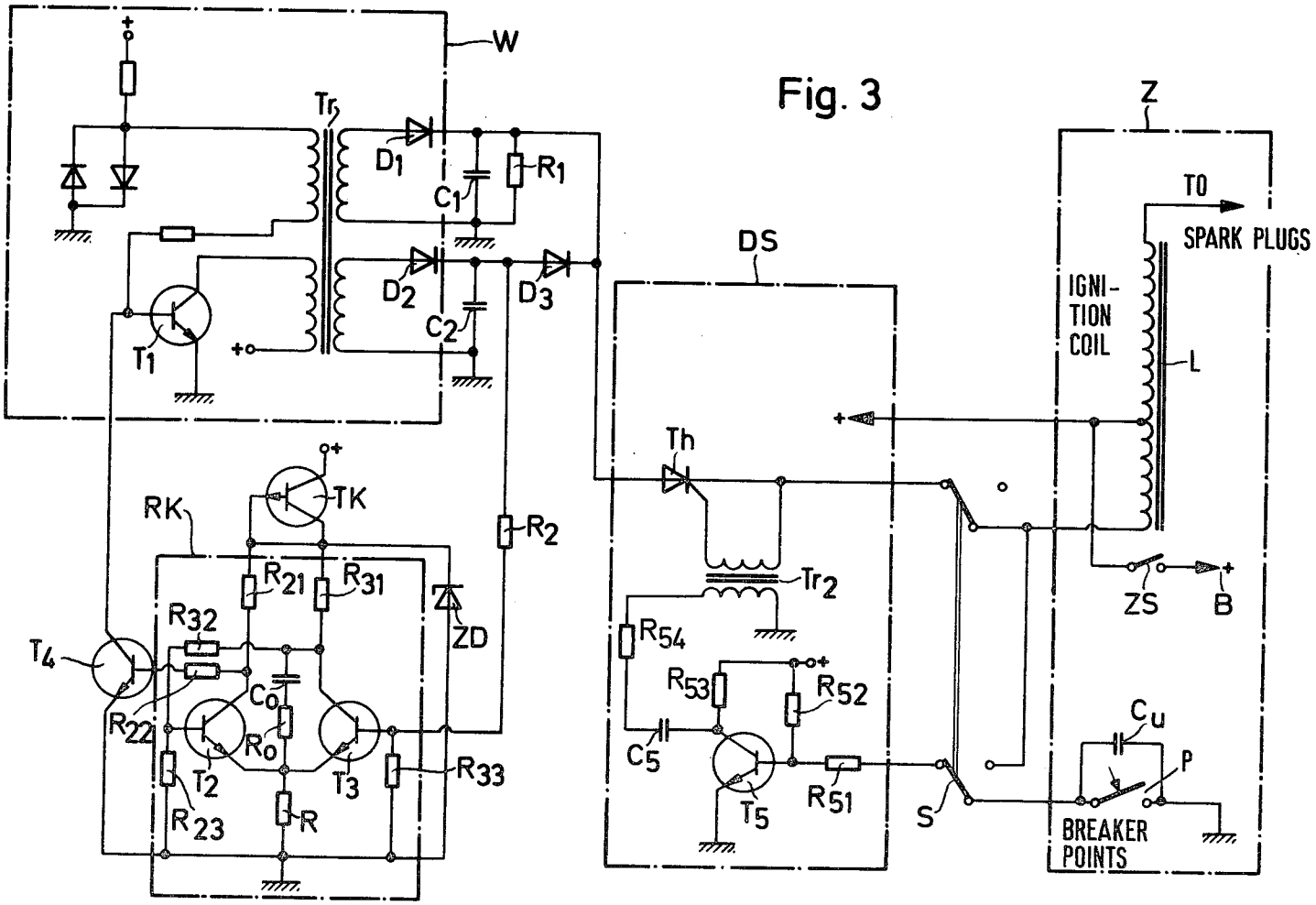
FIG. 3 is a complete equivalent circuit diagram of the ignition system of FIG. 1.

Firing of the thyristor in the switch-through circuit DS, which will be discussed in greater detail with respect to FIG. 3, is effected in a known manner with the aid of a capacitor discharge and the resulting pulse from a firing transformer. After switching through of the thyristor to its conductive state, the current flux period is determined only by the time in which the discharge current of capacitor $C_1$ and subsequently that of capacitor $C_2$ is higher than the holding current of the thyristor. If the current falls below the holding current during discharging of capacitor $C_2$, the thyristor blocks again. A small portion of the stored energy therefore remains in capacitors $C_1$ and $C_2$.

FIG. 1 also shows a switching arrangement S for bypassing the capacitor discharge ignition system and for switching to normal coil ignition. With the appropriate position of switching arrangement S, the ignition coil is fed directly by the battery B with the breaker points closed, and when the breaker points are opened, the charge surge from the capacitor produces the ignition pulse in the ignition coil in the known manner.

Figure 2:
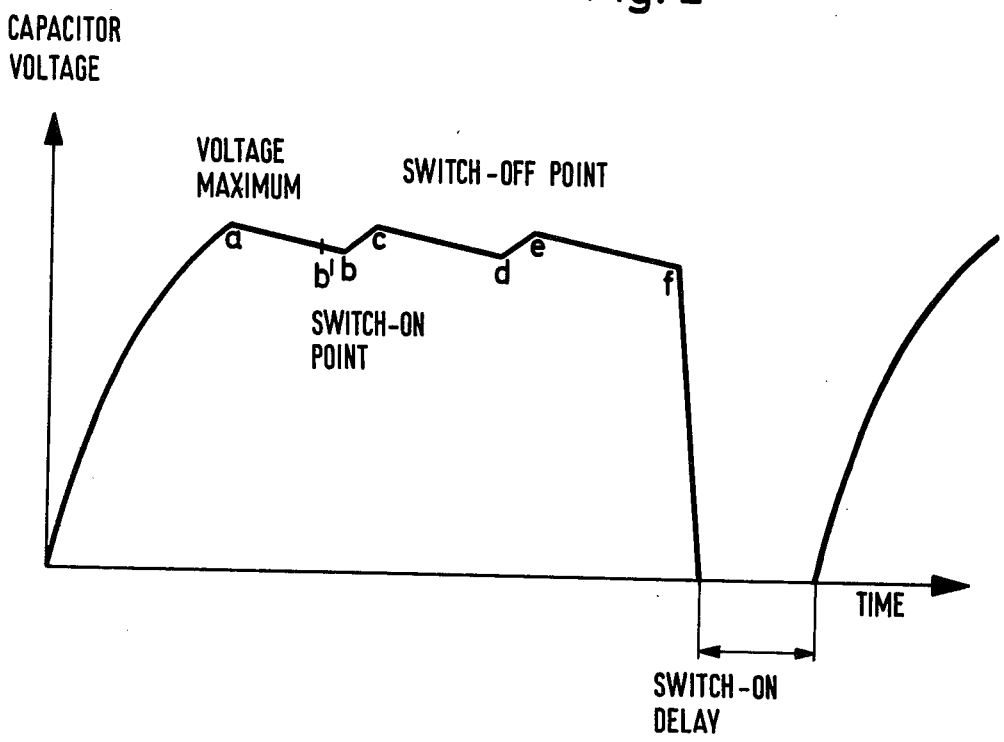
FIG. 2 shows the voltage curve at one of the storage capacitors of FIG. 1.

FIG. 2 shows the path of the voltage across the storage capacitor $C_1$ during the charging process and during the storage of energy. The control circuit RK switches off converter W so that it no longer delivers charging pulses to the capacitors $C_1$ and $C_2$ when a certain voltage designated as the switch-off value has been reached across capacitor $C_2$. Pursuant to the considerations regarding the dimensions of storage capacitors $C_1$, $C_2$ which will be discussed in connection with FIG. 3, the storage voltage across capacitor $C_1$ will then also be sufficient to form the ignition spark. In order to prevent charging of the capacitors, particularly of capacitor $C_1$, to unduely large voltage values and consequently the formation, with the aid of the inductances in the circuit, of a resonant circuit with undesirable high frequency phenomena (particularly if only the ignition has been switched on), a discharge resistor $R_1$ is provided in parallel with the capacitor $C_1$ to permit a partial discharge. As will be described more fully with regard to FIG. 3, coupling resistor $R_2$ simultaneously serves as the discharge resistor for capacitor $C_2$. Consequently, as shown in FIG. 2 according to the curve of the first charge, the capacitor $C_1$ is initially charged to the maximum value at point a after which the converter W is switched off and a partial discharge occurs. A first recharge can take place at point b and then further partial discharges and recharges until the capacitor $C_1$ is switched through for discharge at point e. After the switch-on delay period, this cycle of partial charging steps begins anew under control of the control circuit RK.

The partial discharges i.e. the decrease of the storage voltage of the capacitors $C_1$, $C_2$, according to the portions a to b and c to d of the path of the voltage in FIG. 2 result from the leakage currents of these capacitors and certain other components, e.g. the thyristor of the circuit DS, which are connected to these capacitors. The converter W, being a free running oscillator, is not able to oscillate during the partial discharges because it is blocked or switched off by the control circuit RK. The points b and d of the partial path of the voltage at which the recharges begin are determined from the characteristics of the input transistor $T_3$ of (FIG. 3) of the circuit RK. That is, the circuit RK flips and switchs on the converter W if the transistor $T_3$ changes to its conductive state according to its base-emitter-characteristic $U_{BE}$ as will be more fully described below with regard to FIG. 3. It should be noted that the circuit RK provides a switch-on delay following each partial discharge in the same manner as the switch-on delay provided following full discharge of the capacitors. However, in order to assure the clearness of the representation in FIG. 2 the switch-on delay following the partial discharges has not been considered. In the case of its diagram the control circuit RK would flip e.g. at a point b' before point b, as shown in FIG. 2. Moreover, because of the construction of the converter W, as a free running oscillator the recharges of the capacitors $C_1$, $C_2$, do not take place in a single surge but according to a staircase form curve as is well known. For a simplified schematical representation the respective portion of the curve is drafted as an approximatly straight line in FIG. 2.

Turning now to FIG. 3 there is shown a circuit diagram for a preferred embodiment for the capacitor ignition circuit according to the invention. The known ignition circuit of a conventional coil ignition for an internal combustion engine is indicated at Z. This ignition circuit Z, comprising the ignition coil L, the breaker points P and the capacitor $C_u$, is connected to the battery via the ignition switch ZS. The double pole switch S permits switching from capacitor ignition (the illustrated position) to conventional coil ignition.

The switch-through circuit DS which may be considered to be an electronic switch, releases the energy stored in capacitors $C_1$, $C_2$ for the ignition coil L in a rhythm determined by the timing of the operation, i.e., opening and closing of the breaker points P. The circuit component for releasing the firing energy is a thyristor Th which is connected between the capacitors $C_1$, $C_2$ and the ignition coil L and whose control electrode is charged with firing pulses from a transformer $Tr_2$. With closed breaker points P, current flows from the battery through resistors $R_{52}$ and $R_{51}$ toward ground. These resistors are dimensioned so that in such case transistor $T_5$ is blocked. At the same time capacitor $C_5$ is charged via resistor $R_{53}$. When the breaker points P open, the transistor $T_5$ switches through due to a different voltage division in the base circuit of transistor $T_5$ and the resulting flow of base current through resistor $R_{52}$, and causes capacitor $C_5$ to discharge via $R_{54}$ so that a pulse for the control electrode of thyristor Th is generated in transformer $Tr_2$. The specific switch-through circuit DS is not an object of the present invention and may also be designed in a different, known manner.

The blocking converter W and its control circuit RK serve to regulate the generation of firing energy in storage capacitors $C_1$ and $C_2$ in the rhythm or timing of the operation of the breaker points P.

The converter W includes a known so-called single-ended circuit or blocking oscillator including transformer Tr and transistor $T_1$ for charging, according to the invention, capacitors $C_1$ and $C_2$ to enable them to store the firing energy. In this single-ended circuit the transformer Tr initially serves as the energy store for magnetic energy in that a magnetic field is alternatingly built up and broken down. During the so-called "blocking phase", i.e., during the time interval in which the field is being broken down, the capacitors $C_1$ and $C_2$ are charged. For this purpose, respective rectifiers $D_1$ and $D_2$ are provided. The single-ended circuit is designed so that the storage capacitor $C_1$ is charged to a voltage corresponding to the transformation ratio of the ignition coil L to produce a breakthrough voltage of about 15 to 30 kV to ionize the spark path, and capacitor $C_2$ is charged to a voltage to produce the post discharge voltage of about 0.5 to 2 kV. For example, capacitor $C_1$ may have a voltage of 300 to 400 Volt and capacitor $C_2$ a voltage of about 100 Volt.

The control circuit RK includes a modified Schmitt trigger having output and input transistors $T_2$ and $T_3$, respectively and a series RC circuit Ro, Co, connected in parallel with the emitter-collector path of the transistors $T_2$ and $T_3$, as well as a switching transistor $T_4$ which is controlled with and responsive to the state of the output transistor $T_2$. The input of the control circuit RK, and in particular the base of input transistor $T_3$, is connected to the capacitor $C_2$ via the resistor $R_2$ and is responsive to the voltage or the capacitor $C_2$, while the switching transistor $T_4$ is connected to and controls the state of the transistor $T_1$ of the blocking converter circuit w. In order to assure a stabilized voltage supply for the control circuit RK the voltage supply is realized by a field effect transistor TK which is connected as constant current source and a voltage stabilizing Zener diode ZD. With this arrangement the blocking converter W is always triggered with the same operating parameters.

In the discharged state of storage capacitors $C_1$, $C_2$, input transistor $T_3$ of the Schmitt trigger is blocked since the base resistor $R_{33}$ is connected to ground and the base current flowing through coupling resistor $R_2$ of converter W to control circuit RK is initially insufficient to cause switching of transistor $T_3$ to its unblocked state. At the same time, output transistor $T_2$ of the Schmitt trigger is conductive because a base current can flow through resistors $R_{31}$, $R_{32}$ and R. The collector of transistor $T_2$ has a very low potential—resistor R produces a voltage drop of, for example, about 0.3 Volt—so that the base current for switching transistor $T_4$ is not sufficient to switch transistor $T_4$ to its conductive state. Switching transistor $T_4$ is therefore blocked and consequently transistor $T_1$ is unblocked and converter W is able to oscillate to generate the firing energy.

When storage capacitor $C_2$ is being charged, and a certain voltage drop is reached across resistor $R_2$, a corresponding base current causes transistor $T_3$ to become conductive and short-circuits the base circuit of transistor $T_2$. When transistor $T_2$ blocks, however, a base current can flow through resistors $R_{21}$ and $R_{22}$ and through switching transistor $T_4$, which is then conductive, so that transistor $T_1$ of converter W is blocked and the converter W ceases to oscillate.

Discharging of the storage capacitors $C_1$, $C_2$, causes the input transistor $T_3$ of the Schmitt trigger, and hence of the control circuit RK, to block and the charging rhythm begins anew. A charging current then flows initially through resistor $R_{31}$ into capacitor $C_0$, which is charged via resistors $R_{31}$ and $R_0$ after a time constant, which delays switching through of transistor $T_2$ and thus switching off of transistor $T_4$. This time constant, which is formed according to the present invention by the series connection of the capacitor $C_0$ and resistors $R_{31}$ and $R_0$, constitutes the intended switch-on delay period which prevents converter W from starting to oscillate too early and thus finish undesirable firing energy at the end of the period of dwell of the ignition spark.

If after charging of capacitor $C_0$ the potential conditions permit a base current to flow through transistor $T_2$ via resistor $R_{32}$, transistor $T_2$ becomes conductive. Consequently transistor $T_4$ blocks and thus converter W is separated electrically from control circuit RK.

As mentioned above with respect to FIG. 2, between the full charging and discharging of the storage capacitors $C_1$ and $C_2$, partial discharges i.e., the decrease of the storage voltage of the capacitors $C_1$, $C_2$, according to the portions a to b and c to d of the path of voltage in FIG. 2, result from the leakage currents of these capacitors, of the diodes $D_1$, $D_2$, and of the thyristor Th.

The converter W, being a free running oscillator, is not able to oscillate during the partial discharges because the transistor $T_4$, operating as a switch towards ground, is in the conductive state and thereby the transistor $T_1$ of the converter W is blocked.

The points b and d of the path of voltage in FIG. 2 at which the recharges begin are determined from the characteristics of the transistor $T_3$ of the circuit RK. That is, the circuit RK flips and switches on the converter W if the transistor $T_3$ changes to its conductive state according to its base emitter characteristic $U_{BE}$. For example, with the resistor R of zero Ω and with usual specifications for $U_{BE}$ of 0.7 volts in the conductive state and $U_{BE}$ of 0.6 volts in the blocked state of the transistor $T_3$, that is a voltage decrease of 16 percent, the control circuit RK switches on the converter W for recharging of the capacitors $C_1$, $C_2$. If the proportioning of the resistor R results from a voltage drop of 1 volt with the same specification for the voltage $U_{BE}$ of the transistor $T_3$ as mentioned above, a voltage decrease of 6 percent leads to flipping of transistor $T_3$ to the blocked state and therewith to switching on of the converter W. Each time the transistor $T_3$ changes to its conductive state the capacitor $C_0$ is discharged. Consequently the discharging step of the capacitor $C_0$ occurs both with the full discharges of the storage capacitors $C_1$, $C_2$, to supply firing energy to the ignition coil and with the partial discharges between the full discharges.

When the transistor $T_3$ is blocked a charging current initially flows through the resistor $R_{31}$ into the capacitor $C_0$ also in connection with the partial discharges. Thus in the following recharging steps the switch-on delay with aid of the devices $R_0$ and $C_0$ is equally achieved.

The resistances of control circuit RK can be determined from the switch-on delay time as well as the selection of transistors $T_2$ to $T_4$.

It can be assumed that transistor $T_4$ must "switch" a base current from transistor $T_1$ of no more than 1 A. If, for example, this base current is 500 mA and the current amplification is $\beta 50$, a base current of 10 mA would result for transistor $T_4$. This again results with a voltage stabilized by the Zener diode ZD at for example, 4.7 Volt and, with symmetrical dimensions of the trigger and an appropriately selected transistor $T_2$, in the dimensions of resistors $R_{21}$ and $R_{22}$. Also, if the base current for transistor $T_4$ is known, the collector current is given by transistor $T_2$. If resistors $R_{21}$ and $R_{22}$ are approximately equal and with the above-mentioned parameters, transistor $T_2$ carries a collector current of about 20 mA and transistor $T_3$ is selected to correspond.

From the characteristics of transistors $T_3$ and $T_2$ and from the given supply voltage there then also result the values for resistors $R_{31}$, $R_{23}$ and $R_{32}$.

The switch-on delay time can be determined by the firing intervals of an engine capable of high numbers of revolutions which intervals occur at 5 msec, for example, as well as by the period of dwell of the ignition spark, which may be about 1.5 msec, and it is assumed to be 0.5 msec, for example. From this finally, once resistance $R_{31}$ has been determined, the capacitance of capacitor $C_0$ can be calculated. With the above assumed times, the time available for charging the storage capacitors would be a maximum of 3 msec.

As can be seen from the above description of the operation, the storage capacitors $C_1$ and $C_2$ are discharged to form the ignition spark in the rhythm of the firing order. The build-up and breakdown of the field in the transformer Tr of converter W, i.e., its ocillations, and thus the frequency of charging the storage capacitors $C_1$ and $C_2$ is, however, determined also by the discharge resistor $R_1$, the transistor circuit $T_2$, $T_3$ of control circuit RK and by voltage divider $R_2$-$R_{33}$ in the base circuit of input transistor $T_3$, and can therefore take place independently of the ignition cycle. During the charging period for the storage capacitors, which period is given by the frequency of the ignitions or sparks, it is possible, as shown in the illustration of FIG. 2, for the capacitors to be charged several times, even under extreme operating conditions.

The discharge resistors $R_1$ and $R_2$ should be dimensioned under consideration of the condition that the time constants of the two thus formed parallel RC circuits coincide substantially. It must additionally be noted in dimensioning resistor $R_2$, which together with resistor $R_{33}$ forms the base voltage divider for the input transistor $T_3$ of the control circuit RK, that the voltage drop produced by the base current from transistor $T_3$ must not influence the potential relationships in the storage circuit of capacitor $C_2$. If transistor $T_3$ is selected according to the above dimensioning instructions, resistor $R_2$ may be, for example, in the order of magnitude of 100 KΩ.

The capacity of storage capacitors $C_1$ and $C_2$ is not critical. It is determined substantially by the requirement that the energy content of the two capacitors at low numbers of revolutions is at least equal to that of the ignition coil in a conventional coil ignition system. As a specific numerical example of the inventive system the following devices can be applied:

For the converter W an input resistor of 1 KΩ; two fast diodes of 0.5 Amp.; a transistor $T_1$ of the type 2N3771 and a base resister of 56Ω; a ferrite core transformer Tr with a first primary winding of 20 coils wire of 0.4 mm a second primary winding —for transistor $T_1$—of 27 coils wire of 0.8 mm, a first secondary sinding of 360 coils wire of 0.15 mm and a second secondary winding of 113 coils wire of 0.15 mm; fast diodes $D_1$ and $D_2$ of respectively 1000 Volts and 250 Volts breakdown voltage; storage capacitors $C_1$ and $C_2$ of 0.47 μF respectively 4.7 μF and discharge resistors $R_1$ and $R_2$ of 2.2 MΩ and respectively 220 KΩ;

Further for the control circuit RK a constant current source TK of two field effect transistors of the type BF245-C in parallel; resistors $R_{21}$ of 470Ω, $R_{31}$ of 470Ω, $R_{32}$ of 8.2 KΩ, $R_{22}$ of 470Ω, $R_{23}$ of 8.2 KΩ, R of 150Ω, $R_{33}$ of 3.6 KΩ and $R_o$ of 22Ω; transistors $T_2$ and $T_3$ each of the type BC108C and transistor of the type 2N3019; a capacitor $C_o$ of 0.33 μF and a zener diode for 4.7 Volts and for the switching-through circuit DS a usual thyristor Th of 1000 Volts in connection with a conventional firing transformer Tr, resistors $R_{51}$ of 3.3Ω, $R_{52}$ of 180Ω, $R_{53}$ of 220Ω and $R_{54}$ of 4.7Ω; a capacitor $C_5$ of 4.7 μF and a transistor $T_5$ of the type 2N3019.

It will be understood that the above description of the present invention is susceptible to various modifications, changes and adaptations, and the same are intended to be comprehended within the meaning ad range of equivalents of the appended claims.

What is claimed is:

1. In a capacitor ignition system for an internal-combustion engine including a direct voltage converter, at least one storage capacitor connected to the output of said converter, control circuit means, coupled to said converter and to said storage capacitor, for regulating the operation of said converter to cause same to cyclically charge said capacitor, an ignition voltage firing circuit including an ignition coil and breaker points, and switch-through circuit means, connected between said storage capacitor and said ignition coil and responsive to the opening and closing of said breaker points, for discharging said storage capacitor in dependence on the firing frequency; the improvement wherein: there are first and second storage capacitors each connected to the output of said converter and to the input of said switch-through circuit means with said first storage capacitor essentially for storing the firing energy required to ionize the ignition spark path of the spark plug connected to said ignition coil and said second storage capacitor essentially storing the firing energy required to assure a period of dwell for the ignition spark;

said control circuit means includes a series RC timing circuit means for delaying the switching on of said converter after the discharge of said capacitors by said switch-through circuit means; and the circuit components of said converter and of said control circuit means for charging said capacitors are dimensioned so that the frequency of charging of said capacitors is independent of the ignition order frequency of the breaker points.

2. A capacitor ignition system according to claim 1 wherein: said control circuit means includes a transistor Schmitt trigger circuit and a switching transistor; said Schmitt trigger circuit having an input transistor whose base is connected said second storage capacitor and is responsive to the charge voltage on said second storage capacitor, and an output transistor whose output is connected to and controls the conducting state of said switching transistor; said switching transistor is connected to said converter means and controls the operation of same; and said ignition system further comprises means for supplying a stabilized supply voltage to said Schmitt trigger circuit, said supply voltage means including a constant current source circuit component having a voltage stabilizing component connected thereto.

3. A capacitor ignition system as defined in claim 2 wherein said constant current circuit component is field effect transistor.

4. A capacitor ignition system as defined in claim 3 wherein said voltage stabilizing component is a Zener diode.

5. A capacitor ignition system as defined in claim 2 wherein said series RC circuit means is connected in parallel with the collector-emitter path of said input transistor.

6. A capacitor ignition system as defined in claim 5 wherein: first and second ohmic resistors are connected in parallel with said first and second storage capacitors, respectively; and said first and second storage capacitors and said first and second resistors are each dimensioned so that the time constants of the respective parallel RC circuits are at least approximately equal.

7. A capacitor ignition system as defined in claim 6 wherein said base of said input transistor is connected to said second storage capacitor via at least a portion of said second resistor.

8. A capacitor ignition system as defined in claim 6 wherein said direct current converter is a single-ended circuit including a further transistor connected to respective windings of a transformer, said transformer having a pair of output secondary windings, each of which is connected to a respective one of said first and second storage capacitors via respective rectifier, and said further transistor is connected to and controlled by said switching transistor and said capacitors are charged only when said further transistor is blocked.

9. A capacitor ignition system as defined in claim 1 wherein: first and second ohmic resistors are connected in parallel with said first and second storage capacitors, respectively; and said first and second storage capacitors and said first and second resistors are each dimensioned so that the time constants of the respective parallel RC circuits are at least approximately equal.

10. A capacitor ignition system as defined in claim 1 wherein: said direct current converter is a single-ended circuit including a transistor connected to a transformer, each of said first and second storage capacitors is connected to a respective output winding of said transformer via a respective rectifier; and said transistor is responsive to a output signal from said control circuit means to cause said con-converter to oscillate and to charge said storage capacitors.

* * * * *